US006832129B2

(12) United States Patent
Lesh et al.

(10) Patent No.: US 6,832,129 B2
(45) Date of Patent: Dec. 14, 2004

(54) METHOD FOR PACKING RECTANGULAR STRIPS

(75) Inventors: Neal B. Lesh, Cambridge, MA (US); Michael D. Mitzenmacher, Lexington, MA (US); Joseph W. Marks, Belmont, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 0 days.

(21) Appl. No.: 10/374,194

(22) Filed: Feb. 26, 2003

(65) Prior Publication Data

US 2004/0167661 A1 Aug. 26, 2004

(51) Int. Cl.[7] ..... G06F 17/00
(52) U.S. Cl. ..... 700/213; 414/273; 414/900
(58) Field of Search ..... 700/213; 414/273, 414/900, 902

(56) References Cited

U.S. PATENT DOCUMENTS 4,692,876 A * 9/1987 Tenma et al. ..... 700/249
5,050,090 A * 9/1991 Golub et al. ..... 700/217
5,473,545 A * 12/1995 Schausten ..... 700/215
6,286,656 B1 * 9/2001 Huang et al. ..... 198/502.2

OTHER PUBLICATIONS

Coffman et al., "Approximation algorithms for bin–packing: an undated survey," *Algorithm Design for Computer Systems Design*, Springer–Verlag, Ausiello et al. editors, pp. 49–106 1984.

Hopper et al., "An Empirical Investigation of Meta–heuristic and Heuristic Algorithms for a 2D Packing Problem," European Journal of Operational Research, 128(1) : 34–57, 2000.

* cited by examiner

*Primary Examiner*—Khoi H. Tran
(74) *Attorney, Agent, or Firm*—Dirk Brinkman; Andrew Curtin

(57) ABSTRACT

A method packs input rectangles into a target rectangle. The rectangles are permuted into one or more an ordered list according to dimensions of the rectangles, e.g., width, height, perimeter, and area. The rectangles are then marked as unaccepted. A next unaccepted rectangle is selected from the ordered list beginning with a first rectangle in the list. Accepting the next rectangle if it is the last unaccepted rectangles, and otherwise, accepting the next rectangle with a probability p, and marking the next rectangle as accepted, and repeating the steps until all rectangles have been accepted.

23 Claims, 2 Drawing Sheets

METHOD FOR PACKING RECTANGULAR STRIPS

FIELD OF THE INVENTION

The present invention is directed generally to a system and method for solving packing and component layout problems, and more particularly to packing rectangular strips.

BACKGROUND OF THE INVENTION

In manufacturing, it is frequently necessary to lay out patterns on a large piece of stock, and then to cut the stock into smaller pieces of various sizes to make a finished product. Typically, the component pieces must be located in such a manner that certain spatial constraints are satisfied. These spatial constraints often include orientation, proximity, and overlap. This is generally known as the "packing" problem.

For example, an article of clothing is usually made from various irregularly shaped pieces cut from a bolt of fabric. Similarly, a piece of furniture may require specific rectangular pieces of glass or wood cut from a large sheet of glass or plywood. In all cases, it is desired to minimize both the amounts of stock and waste.

Although the two-dimensional (2D) rectangular strip packing problem is more constrained than the general case of irregular shaped pieces, it is still important to many engineering and manufacturing applications, see Coffman et al., "Approximation algorithms for bin-packing: an updated survey," *Algorithm Design for Computer Systems Design*, Springer-Verlag, Ausiello et al. editors, pp. 49–106 1984, and Dyckhoff, "Typology of cutting and packing problems," European Journal of Operational Research, 44, pp. 145–159, 1990.

When a computerized method is used to solve the 2D rectangular strip packing problem, the input is typically a permuted list of n input rectangles along with their dimensions, and a target width W. The object is to pack the n input rectangles, without overlap, into a single target rectangle of width W, and a minimum height H. A spatial constraint requires that all rectangles are placed orthogonally and parallel to the horizontal and vertical axes, i.e., the rectangles cannot be rotated, other than in 90° steps. Like most packing problems, 2D rectangular strip packing, even with these spatial constraints, is NP-hard, because the number of different permutations that are possible is exponentially large in the number of rectangles.

One method for packing takes the list of input rectangles, and sorts them according to width or height, and greedily place the sorted rectangles, one by one, on the target rectangle. Perhaps, the most studied and effective heuristic, with the above constraints, is the bottom-left (BL) heuristic, where rectangles are placed sequentially, first as close to the bottom as possible, and then as far to the left as the rectangles can fit.

However, for some problems, the BL heuristic cannot find the optimal packing, nor does it perform well when applied to random instead of sorted orderings, see Baker et al., "Orthogonal packings in two dimensions," SIAM Journal on Computing, 9:846–855, 1980, and Brown, "An improved BL lower bound," Information Processing Letters, 11:37–39, 1980.

However, a very successful approach applies the BL method to permutations of rectangles that are ordered by decreasing height, width, perimeter, and area, and returns the best of the four packings that result see Hopper, "Two-Dimensional Packing Utilising Evolutionary Algorithms and other Meta-Heuristic Methods," Ph.D. Thesis, Cardiff University, UK, 2000. That method is referred to as bottom-left-decreasing (BLD).

A natural alternative approach would find good orderings of the rectangles for BL or other similar heuristics, using standard search techniques such as simulated annealing, genetic algorithms, or tabu search. However, despite significant efforts in this area, the large search space has not proven amenable to such search techniques, see Hopper et al., "An Empirical Investigation of Meta-heuristic and Heuristic Algorithms for a 2D Packing Problem," European Journal of Operational Research, 128(1):34–57, 2000.

Another approach uses an approximation procedure. The BL heuristic has been shown to be a 3-approximation when the rectangles are sorted by decreasing width. However, that approach is not competitive when sorted by decreasing height. Other approaches give an asymptotic 5/4-approximation, see Baker et al., "A 5/4 algorithm for two-dimensional packing," Journal of Algorithms, 2:348–368, 1981, and an absolute 5/2-approximation, see Sleator, "A 2.5 times optimal algorithm for packing in two dimensions," Information Processing Letters, 10:37–40, 1980. A fully polynomial approximation scheme has also been described, see Kenyon et al., "Approximate Strip-Packing," Proceedings of the $37^{th}$ Annual Symposium on Foundations of Computer Science," pp. 31–36, 1996.

For many practical applications, humans usually outperform the best computerized methods, particularly for irregular shapes. Because humans still appear to be able to do better than automated methods, it is desired to provide an interactive system and method where the user can improve upon solutions provided by a computerized method.

SUMMARY OF THE INVENTION

The invention provides a method for optimally packing input rectangles into a target rectangle. The method can be used in a divide-and-conquer process for packing problems with a large number of rectangles. In addition, an interactive interface can be used to improve upon computer generated solutions.

A method packs input rectangles into a target rectangle. The rectangles are permuted into one or more an ordered list according to dimensions of the rectangles, e.g., width, height, perimeter, and area.

The rectangles are then marked as unaccepted. A next unaccepted rectangle is selected from the ordered list beginning with a first rectangle in the list. Accepting the next rectangle if it is the last unaccepted rectangles.

Otherwise, accepting the next rectangle with a probability p, and marking the next rectangle as accepted, and repeating the steps until all rectangles have been accepted.

DETAILED DESCRIPTION OF THE PREFERRED EMBODIMENT OF THE INVENTION

Figure 1:
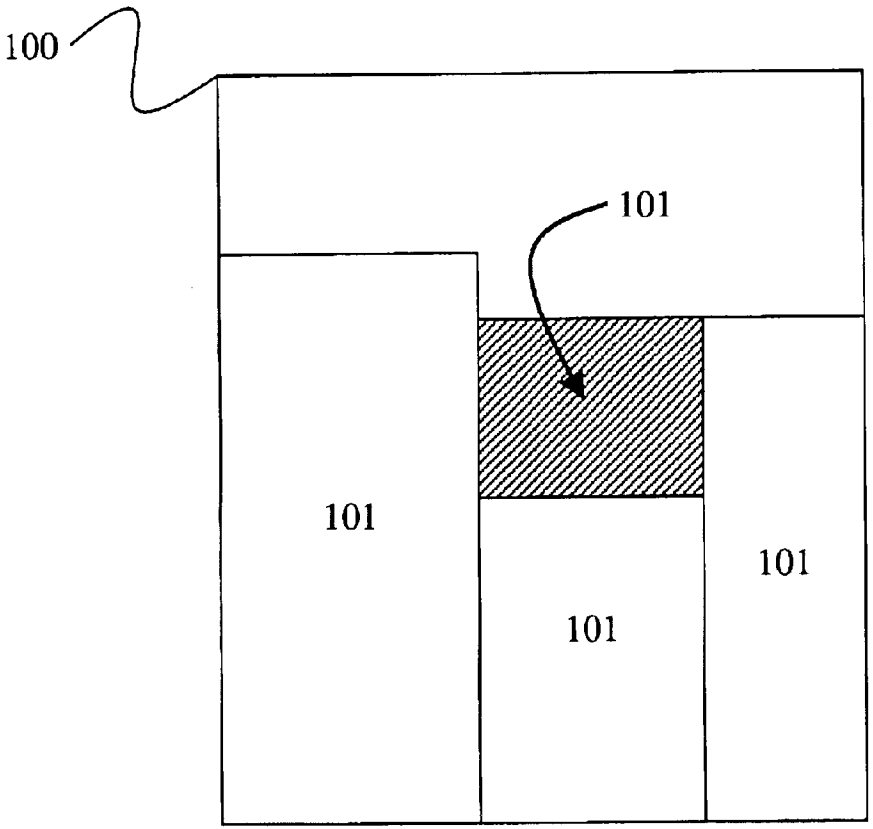
FIG. 1 is a block diagram of packing problem with three input rectangles and a gap.

Our invention provides a system and method for solving packing problems where two-dimensional (2D) rectangular strips of various sizes need to be placed into a single target rectangle of width W, and a minimum height H. All rectangles must be placed orthogonally and parallel to their horizontal and vertical axes.

Exhaustive Branch-and-Bound Method

For completeness, we first describe an exhaustive branch-and-bound method that performs extremely well on packing problems with less than about thirty rectangles. Our method is especially well suited for finding perfect packings. In a perfect packing, the input rectangles fit exactly into the target rectangle of the appropriate width, with no empty space. Our method also generalizes to the case where the packing is imperfect.

Bottom-Left Heuristic

The bottom-left (BL) heuristic, described above, is perhaps the most widely used heuristic for placing rectangles. We think of points in the rectangle to be packed as being ordered lexicographically, so that a point A lies before a point B when A is below B or, when points A and B have the same height and A is to the left of B.

Given a permutation of the rectangles, the BL heuristic places the input rectangles sequentially with the bottom left corner of each being placed at the first point in the lexicographic ordering where the rectangle will fit. There are a number of known worst-case methods for this problem with complexity $O(n^3)$. Another method requires $O(n^2)$ time, and $O(n)$ space in the worst case, see Chazelle, "The Bottom-Left Bin-Packing Heuristic: An Efficient Implementation," IEEE Transactions on Computers, 32(8):697–707, 1983. In practice, the method runs faster because, a rectangle can usually be placed in one of the first open spots available.

Perhaps the most natural permutation to select for the BL heuristic is to order the rectangles by decreasing height. This ensures that at the end of the process only rectangles with a small height are placed near the top boundary. It is also natural to permute the rectangles by sorting them in decreasing order by width, area, and perimeter to obtain better solutions. Generally, the sorting by height, width, area, or perimeter is referred to as permuting by a "decreasing dimension" of the rectangles.

Exhaustive Searching for a Perfect Packing

To begin, we consider the use of BL for finding perfect packings. Although there are examples for which BL cannot produce the optimal packing under any ordering, this is not the case when the optimal packing is a perfect packing.

We assert that for every perfect packing, there is a permutation of the input rectangles that yields that perfect packing using the BL heuristic. This can be demonstrated by sorting the bottom left corners of the rectangles in the perfect packing lexicographically. This yields at least one permutation that yields the perfect packing using the BL heuristic.

Our assertion indicates that applying BL exhaustively to all possible permutations of the input rectangles finds a perfect packing, if one exists. Furthermore, it suggests an important optimization for exhaustive search because it shows that there exists a permutation that yields a perfect packing with the BL heuristic such that every input rectangle is placed with the bottom left corner in the first open location in the lexicographic ordering.

Prior art BL heuristics generally places a rectangle in the first open ordering in which it fits.

Thus, a permutation can be rejected as soon as any rectangle does not fit in the first open location. Even though this permutation could possibly yield a perfect packing with the BL heuristic, we are guaranteed to find this perfect packing with some other ordering during our exhaustive search. In the branch-and-bound algorithm, below, we use this idea to dramatically reduce the search space.

Our assertion also suggests an exhaustive search that finds a perfect packing when one exists. Simply try all possible permutations until a perfect packing is found, greedily placing rectangles using the BL heuristic.

In fact, there is a permutation that yields the perfect packing with the BL heuristic where every rectangle is placed with the bottom left corner in the first open location in the lexicographic ordering. We use this fact in a branch-and-bound framework described below.

Branch-and-Bound with Gap Pruning

To efficiently consider all possible permutations, we use a branch-and-bound framework. Rectangles are placed one at a time, so that at any point in time, a prefix of some permutation has been placed. The branch is on the next input rectangle in the prefix of the permutation. In the case, where we have several rectangles with the same dimensions, we can work more efficiently by associating a type with each distinct pair of rectangle dimensions, and branching on the type. The bound is a lower bound on the unused space in any completion of the current prefix.

For perfect packings, we have a trivial bound of zero acceptable empty space. If we can determine that a prefix cannot yield a perfect packing, then we bypass all completions of that prefix, greatly reducing the time for the exhaustive search. We also know that if there is a perfect packing, then there is a permutation that yields the perfect packing where each input rectangle is placed in the first open location in the lexiographic ordering. Thus, if the next rectangle to be placed does not fit in that location, we can immediately prune.

For non-perfect packings, the bound is defined by the best packing found so far, or a user can set an initial bound. In general, for any packing achievable by BL, there is a permutation that yields a packing in which each rectangle is placed at least as high as all previously placed rectangles. This justifies including any unused space below a placed rectangle in the lower bound for the unused space associated with the current prefix.

As shown in FIG. 1, much time can be wasted when the placement of three input rectangles 101–103 in a target rectangle 100 leaves a gap 110 that cannot be filled perfectly, see FIG. 1. Such gaps can arise between placed rectangles, or between placed rectangles and the boundary of the target rectangle 100. The placement of rectangles leaves a gap with a width W and a height H to be filled for a perfect packing. However, none of the remaining rectangles, alone or in combination, can perfectly fill the gap 110, so there is no way to obtain a perfect packing.

We now describe an improvement on our bounding method. To handle this situation, a simple procedure, based on dynamic programming, provides a loose upper bound on the tallest possible rectangle of width W that can be constructed with unplaced rectangles. For the BL heuristic, bounding in this fashion is more useful than bounding the widest possible rectangles of height H, because there are more gaps of small width than of small height, early in the prefix ordering. Although both the width and height can be used, our experience is that the best performance is achieved by using only bounding on the width of the gaps.

Our approach is described as follows. Consider a list of the unplaced rectangles $R_1, R_2, \ldots, R_n$ in some order. The width and height of rectangle $R_i$ are $w(R_i)$ and $h(R_i)$. We find values $B_{j,k}$ that are upper bounds on the maximum height rectangle of width $j \geqq 1$ that can be constructed using the first $k \geqq 1$ rectangles. Hence, $B_{w(R1),1}=h_{(R1)}$, $B_{j,1}=0$ if $j \neq w_{(R1)}$. For $k>1$, we select a. $B_{j,k+1}=B_{j,k}$ if $j<w(R_{k+1})$;

b. $B_{j,k+1}=B_{j,k}+h(R_{k+1})$ if $j=w(R_{k+1})$; and c. $B_{j,k+1}=B_{j,k}+\min(B_{j-w(Rk+1),k}, h(R_{k+1}))$ if $j>w(R_{k+1})$.

Therefore, for all j, $k \geqq 1$, $B_{j,k}$ is an upper bound on the maximum height rectangle of width j that can be constructed using $R_1, R_2, \ldots, R_k$. This bound is loose, because in the case where $j>w(R_{k+1})$, a rectangle $R_i$ with $i \leqq k$ may be contributing to both terms in the summation. If there is no way to place the remaining rectangles to obtain a width W, then $B_{w,n}$ is equal to zero. Further, the bounds can depend on the order in which the remaining rectangles are considered following the procedure above.

Calculating $B_{j,n}$ for every width j, up to the biggest gap, after each placement, and checking that all gaps can at least potentially be filled, enables us to avoid prefixes that cannot yield perfect packings. The bound above can be improved slightly in various ways. For example, taking the best bound from different permutations of the unplaced rectangles, and avoiding overcounting caused by many rectangles with small width. We have found that this technique is effective when applied to a random permutation.

This technique generalizes to non-perfect packings. For example, if there is a gap of width j, and $B_{j,n}$ is zero, then the height of the gap is a lower bound on the unused space inside the gap.

Solution-Richness

Generally, if a problem has at least one perfect packing, then there are typically a great number of solutions. In this case, the problem is solution-rich. Solution-rich problems are more amenable to exhaustive searches, because there are many good solutions to find. We believe that in many cases perfect packing problems are solution-rich, because often rectangles combine into a larger rectangle that can be symmetrically reconfigured in various ways to obtain a different perfect packing.

One class of problems that is provably solution-rich is those with guillotinable solutions. A guillotinable solution has the property that it can be obtained by a sequence of cuts parallel to the axes, each of which crosses either the entire length, or width, or the remaining connected rectangular piece. Guillotinable solutions are important in a number of manufacturing applications. Therefore, we assert that any guillotinable problem on n input rectangles with a perfect packing has at least $2^{n-1}$ perfect packings.

For example, consider the first cut of the guillotinable solution. This divides the problem into two subproblems of size k and l with k+1=n. By induction, these subproblems have $2^{k-1}$ and $2^{l-1}$ perfect packings, respectively, and there are two ways to put the two subproblems together.

Near-Perfect Packings

Our method for efficiently handling perfect packings can also be applied when the optimal packing contains only a small amount of unused space. This can be achieved by simply introducing a small number of 1×1 rectangles, corresponding to the amount of acceptable unused space. This increases the branching factor, although note that all 1×1 rectangles can be treated as of the same type, so the branching increase for k 1×1 rectangles is not as large as for k rectangles with distinct sizes.

Improving the BLD Heuristic

Our exhaustive branch-and-bound method can quickly solve problems with less than thirty rectangles. However, the time it takes to solve the packing problem exhaustively for a large number of triangles is prohibitive.

A natural way to improve the Hopper bottom-left-decreasing (BLD) heuristic, see above is to apply BL to other permutations. At the expense of more time, more permutation orders besides the four suggested above can be tried to attempt to improve the best solution found.

One technique would uniformly select random permutations, and then use the best solution found within the desired time bound. However, random permutations are known to perform poorly, see Hopper above.

Instead, we provide a novel variation of the BLD heuristic that uses a decreasing sorting order. We call our method BLD*. We believe that BLD* performs better than the random BL is that the decreasing sorted order saves smaller rectangles until near the end.

Method Steps

Figure 2:
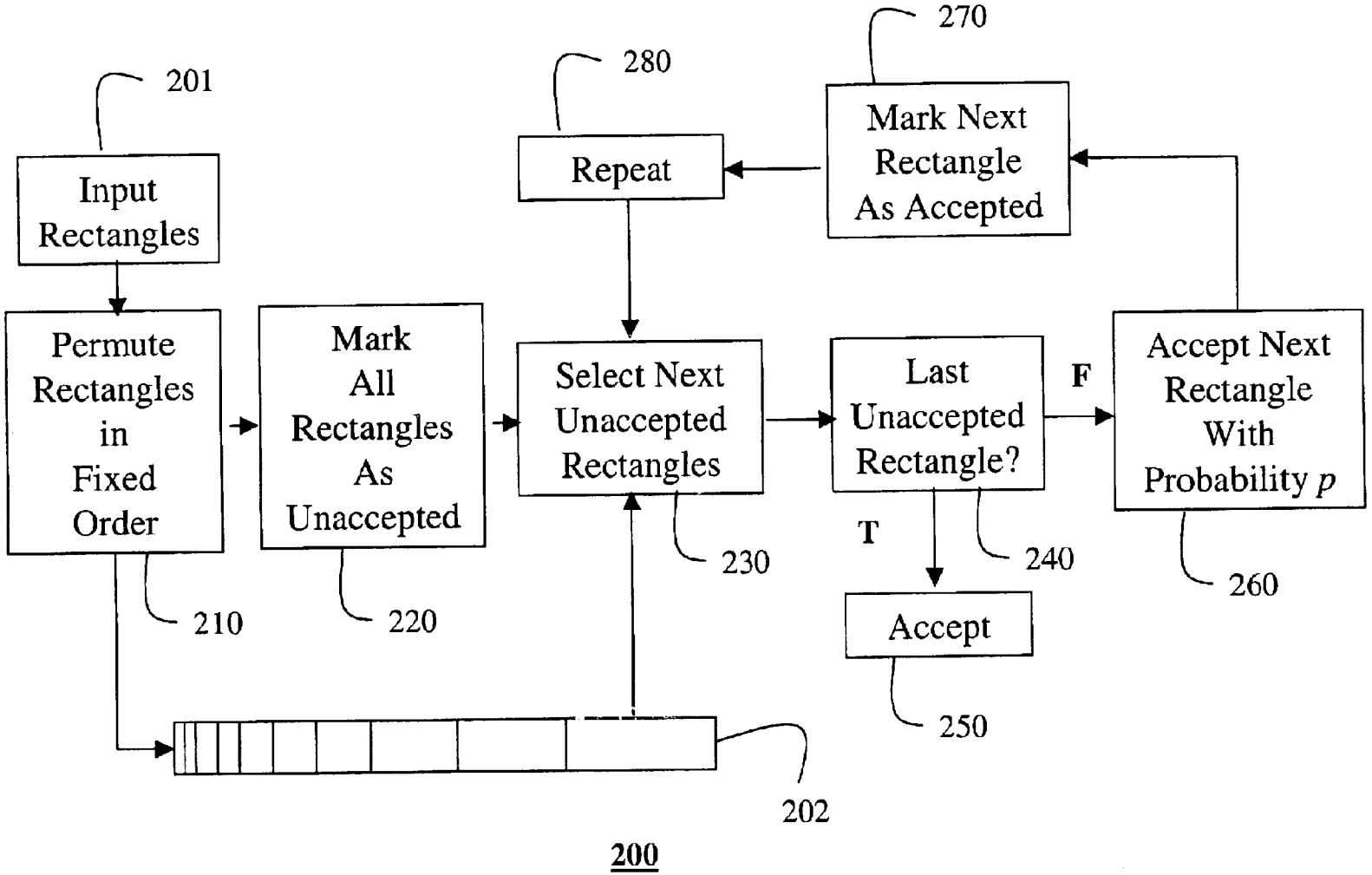
FIG. 2 is a flow diagram of a method for packing rectangles according to the invention.

As shown in FIG. 2, our BLD* method 200 uses the following approach.

First, we permute 210 the input rectangles 201 into an ordered list 202, e.g., a list ordered according to a decreasing dimension such as width, height, perimeter, or area.

At this point, all rectangles in the list 202 are marked 220 as unaccepted.

Then, we generate random permutations from this order as follows.

Select 230 a next unaccepted rectangle from the list in order beginning with a first rectangle in the ordered list.

Determine 240 whether the next rectangle is the last unaccepted rectangle.

If true, accept 250 the next rectangle, and the method completes. By 'accepting' we mean that the next rectangle is placed in the target triangle, using, for example, the BL heuristic.

Otherwise, accept 260 the next rectangle with a probability p, and mark 270 the next rectangle as accepted, and repeat 280 from the selecting step.

Thus, unaccepted rectangles are selected from the list in decreasing order starting with the largest, in terms of the sorting dimension, one at a time. For each selection, BLD* goes down the list of previously unaccepted rectangles in order, accepting each rectangle with probability p, until either a rectangle is accepted. The last unaccepted rectangle in the list is always accepted.

This approach generates permutations that are in a near decreasing sort order, preserving the intuition behind the heuristic, while allowing a large number of variations to be tried.

A variation does not simply take the last rectangle when the end of the input list is reached. Instead, the improvement restarts at the beginning of the list, again taking a rectangle with probability p.

In this case, the probability starting from some fixed ordering x of obtaining some other ordering y is proportional to $(1-p)^{Ken(x,y)}$, where Ken(x,y) is the Kendall-tau distance, also known as bubble-sort distance between the two permutations.

BLD* first tries the four orders used by BLD and then permutes each of these orders in round-robin fashion.

In another variation, the rectangles are rotated in steps of 90° while they are placed. To do so, we created a variation of the BL heuristic. As each rectangle is placed, it is tried in two orientations, which result from rotating the rectangle 90°. For each orientation the rectangle is placed as close to the bottom and then as close to the left as possible. The orientation to use is chosen based on some preference, i.e., whether the upper right corner of the rectangle is bottom or left most, the center of the rectangle is bottom or left most, the lower right corner of the rectnagle is bottom or left most, or a default preference for a tall or wide orientation.

Results

Table A compares results of the prior art BLD method (first row) with results of our BLD* method, when applied to standard sets of rectangles, and using p=0.5. As shown in Table A, our method dramatically improves solutions over the prior art BLD, even with just one minute of computation. Our method continues to improve steadily with time. In addition, our method only required about fifteen permutations before improving upon the best solution of BLD.

i. Table A

| Time in Minutes | Average Height Over Optimal |
|---|---|
| 0 | i. 6.4% BLD |
| 1 | 4.6% |
| 2 | 4.4% |
| 5 | 4.0% |
| 10 | 3.7% |
| 20 | 3.6% |
| 120 | 3.4% |

Interactive Packing

Human guidance has been shown to improve the performance of optimization algorithms for a variety of problems, see U.S. patent application Ser. No. 09/433,422, "Interactive Heuristic Search and Visualization for Solving Combinatorial Optimization Problems," filed on Nov. 4, 1999, and U.S. patent application Ser. No. 10/117,495, "Human-Guided Optimization with Tabu Search," filed Apr. 5, 2002, incorporated herein by reference.

In order for user interaction to be justified for an optimization problem, improvements in solution quality must have a high enough value to warrant investing the effort. This is the case for many practical packing problems, where the manufacturing costs, and thus potential savings, are high. In order for interaction to be applicable to an optimization problem, an effective visualizations for its problems and solutions must be provided.

In order for human interaction to be beneficial, human reasoning must offer some advantages over the best automatic methods. We have found that user help overcomes many of the limitations of the BLD* heuristic.

A user can identify particularly well-packed subregions of solutions, and focus BLD* on improving the other parts. Furthermore, the user can readily envision multi-step repairs to a packing problem to reduce unused space. These repairs often involve producing solutions that would not be produced by the BLD heuristic.

Interactive System

We have developed an interactive rectangle-packing system in Java using the Human-Guided Search (HuGS) Toolkit, see Klau et al., "The HuGS platform: A toolkit for interactive optimization," Proceedings of Advanced Visual Interfaces, pp. 324–330, 2002. The toolkit provides a conceptual framework for interactive optimization as well as software for interacting with a search algorithm, logging user behavior, providing history functions including undo and redo, file I/O, and other GUI functions.

However, we do not utilize the human-guidable tabu or hill-climbing search algorithms provided in HuGS, as we did not find them effective for the packing problem.

In our system, the user is always visualizing a current solution on a display device. Given the aspect ratio of a computer monitor, we found it more natural to rotate the visualization of the problem by 90 degrees, so that there is a fixed height, and the goal is to minimize the width of the target rectangle.

The user can manually adjust the current solution by dragging one or more input rectangles to a new location. The interface includes buttons, which allow the user to cause all the rectangles to be shifted downward or leftward. This basically has the effect of pulling all of the rectangles in one direction until each touches its neighbor or an edge of the target rectangle. These functions also resolve overlap among rectangles. Additionally, the user can freeze particular rectangles. Frozen rectangles are not be moved by the computer.

The user can also specify a sub-target rectangles in which to pack rectangles, denoted by an rectangular outline. The user can then select a search process. Any frozen rectangles within the region are left where they are. The search process then tries to fill the region using any rectangles that are not currently frozen.

The system works in the background, and uses a text display to indicate the value of the best, i.e., most tightly packed, solution it has found so far. The user can also retrieve and modify this solution without disturbing the current search. When the search algorithm finds a new best solution, the user is alerted. The user can optionally set the dimensions of the target rectangle.

More important, the size of the target solution affects how solutions are ranked. Rather than using a true objective function, i.e., the size of the target rectangle, the system ranks solutions based on the total area of the rectangles that fall within the target solution size.

For example, the user typically begins a session by having our BLD* method try to pack the entire target region. Because of our modification, the search algorithm might return, for example, a packing with one rectangle that sticks out of the target region by several units rather than a packing wherein many rectangles stick out of the target region by one unit. We find that the former packings is much easier to repair by users.

Divide-and-Conquer for Large Packing Problems

For some packing problems, it is difficult to improve upon solutions, interactively, using only BLD*. The problem is that the unused space is distributed over a great number of tiny gaps throughout the packing. This makes it more difficult to pack the remaining rectangles into the target space.

However, an automatic divide-and-conquer process is very useful for these large problems. Although the automatic process does not outperform the BLD* method, it does produce solutions that are more amenable to an interactive solution because the unused space amalgamates in larger regions.

We informally describe the process as follows. The method is provided with the dimensions of the target rectangle that is to enclose the input rectangles.

The process then partitions the target rectangle into a set of rectangular sub-target regions, and operates each sub-target region separately. A first region is either as wide as the target rectangle with a random height, or as high as the target rectangle a random width, with bounds on the randomness.

A wide region is selected when there are more wide rectangles need to be placed, otherwise if there are more tall rectangles, a tall region is selected.

To fill the region, the first branch-and-bound method for perfect packing is applied. This fills some portion of the region without introducing any unused space. Then, the rectangles placed in the region are fixed in place, and the second branch-and-bound method, without the perfect-packing constraint, is applied. The rectangles placed by the second invocation of branch-and-bound are also fixed in place. The method then repeats for the remaining space of the target rectangle.

When the remaining area is less than a predetermined threshold size, the BLD* method is applied. This is more effective than treating the remaining area as a region.

As an optimization, each step can be repeated several times for different random values to find a solution with a minimum amount of unused space.

This works well because the branch-and-bound method often fills the first region perfectly, or near perfectly. Thus, all of the unused space is concentrated in the remaining regions. This is an advantage for our interactive method, because it enables the user to focus their repair efforts on a much smaller problem.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for packing a plurality of input rectangles into a target rectangle, comprising:

permuting a plurality of input rectangles into an ordered list;

marking the plurality of rectangles in the ordered list as unaccepted;

selecting a next unaccepted rectangle from the ordered list beginning with a first rectangle in the list;

determining whether the next rectangle is a last unaccepted rectangle;

accepting the next rectangle, if true, otherwise;

accepting the next rectangle with a probability p;

marking the next rectangle as accepted; and repeating from the selecting step.

2. The method of claim 1 wherein the order is according to a decreasing dimension of the plurality of rectangles.

3. The method of claim 2 wherein the dimension is width.

4. The method of claim 2 wherein the dimension is height.

5. The method of claim 2 wherein the dimension is perimeter.

6. The method of claim 2 wherein the dimension is area.

7. The method of claim 1 wherein the last unaccepted rectangle is accepted with the probability p.

8. The method of claim 1 wherein p=0.5.

9. The method of claim 1 further comprising:

permuting the plurality of input rectangles into plurality of ordered lists;

marking the plurality of rectangles in the plurality of ordered list as unaccepted;

selecting, for each ordered list, a next unaccepted rectangle from the ordered list beginning with a first rectangle in the list;

determining, for each ordered list, whether the next rectangle is a last unaccepted rectangle;

accepting, for each ordered list, the next rectangle, if true, otherwise;

accepting, for each ordered list, the next rectangle with a probability p;

marking, for each ordered list, the next rectangle as accepted; and repeating, for each ordered list, from the selecting step.

10. The method of claim 1 wherein the accepting further comprises:

placing the next rectangle in the target rectangle.

11. The method of claim 10 wherein the placing is in a bottom-left order in the target rectangle.

12. The method of claim 1 further comprising:

displaying locations of accepted rectangle, unaccepted rectangles and the target rectangle on an output device.

13. The method of claim 12 wherein user selected accepted rectangles are manually relocated in the target rectangle.

14. The method of claim 13 wherein user selected unaccepted rectangles are manually relocated in the target rectangle.

15. The method of claim 12 wherein user selected accepted rectangles are fixed in place.

16. The method of claim 1 wherein the target rectangle is partitioned into a plurality of sub-target rectangles, and the steps are performed on the sub-target rectangles.

17. The method of claim 9 further comprising:

accepting a best permutation as an optimal packing for the plurality of rectangles.

18. The method of claim 11, further comprising:

selecting an orientation of the rectangle based on a position-preference.

19. The method of claim 18 wherein the position-preference is to position the upper-right corner of the rectangle in the bottom-left most position.

20. The method of claim 2 wherein the dimension is the smaller of width or height.

21. The method of claim 2 wherein the dimension is the greater of width or height.

22. A method for packing a plurality of input rectangles into a target rectangle, comprising:

sorting the plurality of input rectangles into an ordered list according to a decreasing dimension of the plurality of rectangles; and selecting, in order, the plurality of rectangles from the ordered list for packing into the target rectangle in a bottom-left-decreasing order while permuting randomly the ordered list.

23. The method of claim 22 wherein the dimension is selected from a group consisting of width, height, perimeter, and area.

* * * * *